US007520842B2

(12) United States Patent
Comair et al.

(10) Patent No.: US 7,520,842 B2
(45) Date of Patent: Apr. 21, 2009

(54) BICYCLE TRAINER

(75) Inventors: Claude B. Comair, Bellevue, WA (US); Joel N. Smith, Edmonds, WA (US)

(73) Assignee: DigiPen (USA) Corporation, Redmond, WA (US)

( * ) Notice: Subject to any disclaimer, the term of this patent is extended or adjusted under 35 U.S.C. 154(b) by 0 days.

(21) Appl. No.: 11/263,544

(22) Filed: Oct. 31, 2005

(65) Prior Publication Data

US 2007/0099768 A1 May 3, 2007

(51) Int. Cl.
*A63B 69/16* (2006.01)

(52) U.S. Cl. ..... 482/61; 482/54

(58) Field of Classification Search ..... 482/51, 482/57, 61, 54, 65; 601/23, 27–36; 434/247, 434/255

See application file for complete search history.

(56) References Cited

U.S. PATENT DOCUMENTS 4,026,546 A * 5/1977 Omori ..... 482/61
4,082,265 A * 4/1978 Berkes ..... 482/61
4,415,152 A * 11/1983 Smith ..... 482/61
4,580,983 A * 4/1986 Cassini et al. ..... 482/61
4,750,737 A * 6/1988 Smith ..... 482/61
4,817,939 A * 4/1989 Augspurger et al. ..... 482/61
5,662,559 A * 9/1997 Vasquez ..... 482/61
6,500,098 B1 * 12/2002 Werner ..... 482/57

FOREIGN PATENT DOCUMENTS

CH 657782 A5 * 9/1986

* cited by examiner

*Primary Examiner*—Loan H Thanh
*Assistant Examiner*—Tam Nguyen
(74) *Attorney, Agent, or Firm*—Christensen O'Connor Johnson Kindness PLLC

(57) ABSTRACT

A bicycle trainer (100) for supporting a bicycle (200) while a rider rides the bicycle. The bicycle trainer includes a stationary frame (106) adapted to rest upon a support surface (202) and a rotating frame assembly (108). The rotating frame assembly is coupled to the stationary frame, the rotating frame assembly adapted to be coupled to the bicycle and rotate relative to the stationary frame to permit a frame (204) of the bicycle to turn through a predetermined angular displacement (180) relative to the stationary frame.

18 Claims, 3 Drawing Sheets

BICYCLE TRAINER

FIELD OF THE INVENTION

The illustrated embodiments described herein relate generally to bicycle trainers, and more specifically to bicycle trainers that permit a user to ride a bicycle while the bicycle is supported by the bicycle trainer.

BACKGROUND OF THE INVENTION

Currently available bicycle trainers attempt to simulate riding conditions by providing at least some resistance to a rider's exertions and, thereby, achieve a desired level of exercise. Currently, there are of two general types of trainers. The first general type is known as a roller trainer, and the second general type is commonly referred to as a rear wheel or stand trainer.

In a roller trainer, both wheels of a bicycle engage one or more rollers pinned to a frame. During use, the bicycle wheels rotate on the rollers as a rider pedals. In roller trainers, the frame of the bicycle is neither coupled to nor supported by the roller trainer and the rider is required to maintain the bicycle in an upright position.

The rear wheel or stand trainer includes a bracket for rigidly supporting either the rear or front wheel of a bicycle and, thereby, providing some assistance in maintaining the bicycle in an upright position during use. In such a trainer, only the rear wheel of the bicycle rotates as the rider pedals. Such an arrangement eliminates the need for the rider to balance the bicycle on the trainer.

Although effective, both types of trainers are not without their problems. For example, although rear wheel trainers are easy to use, they do not simulate actual riding conditions because the frame of the bicycle is not permitted to move. Specifically, because the frame is rigidly supported by the trainer itself, movement of the bicycle is unnaturally restrained. Additionally, the rigid coupling of the bicycle in the upright manner results in high stresses upon the bicycle frame during use.

Although roller trainers provide a more realistic simulation of riding a bicycle, most users find them very difficult to ride because the frame is not restrained by the trainer itself. Further, such trainers are not designed for simulating turns.

Thus, there exists a need for a bicycle trainer that is reliable, inexpensive to manufacture, and simulates actual riding conditions of a bicycle.

SUMMARY OF THE INVENTION

A bicycle trainer, constructed in accordance with one non-limiting embodiment of the present invention, includes a stationary frame and an attachment assembly coupled to the stationary frame. The attachment assembly is adapted to be coupled to a bicycle for selectively pivoting the bicycle through an angular displacement relative to the stationary frame in response to user input.

A bicycle trainer constructed in accordance with a second non-limiting embodiment of the present invention includes a stationary frame adapted to rest upon a support surface and first and second roller assemblies. The first roller assembly is coupled to the stationary frame for rotatingly engaging a first wheel of a bicycle. The second roller assembly is coupled to the stationary frame and is adapted to permit selective pivoting about a first axis while rotatingly engaging a second wheel of the bicycle.

A bicycle trainer constructed in accordance with yet another non-limiting embodiment of the present invention includes a stationary frame and a coupling frame rotatingly coupled to the stationary frame. The coupling frame includes an attachment assembly adapted to couple to a portion of a bicycle for restraining the bicycle to the bicycle trainer and selectively permitting the bicycle to be angularly displaced relative to the stationary frame.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
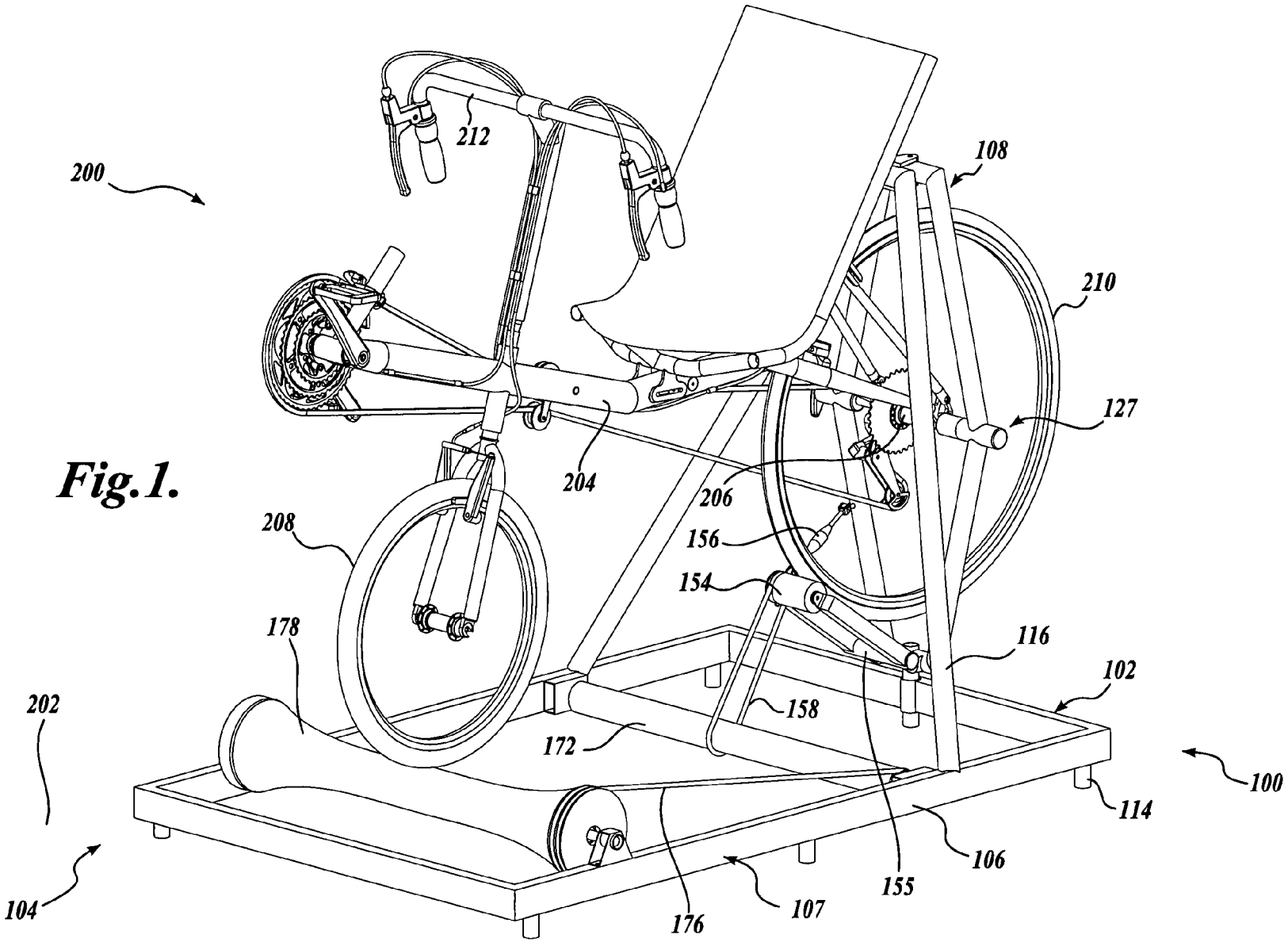
FIG. 1 is an isometric view of a bicycle trainer formed in accordance with one embodiment of the present invention.
Figure 2:
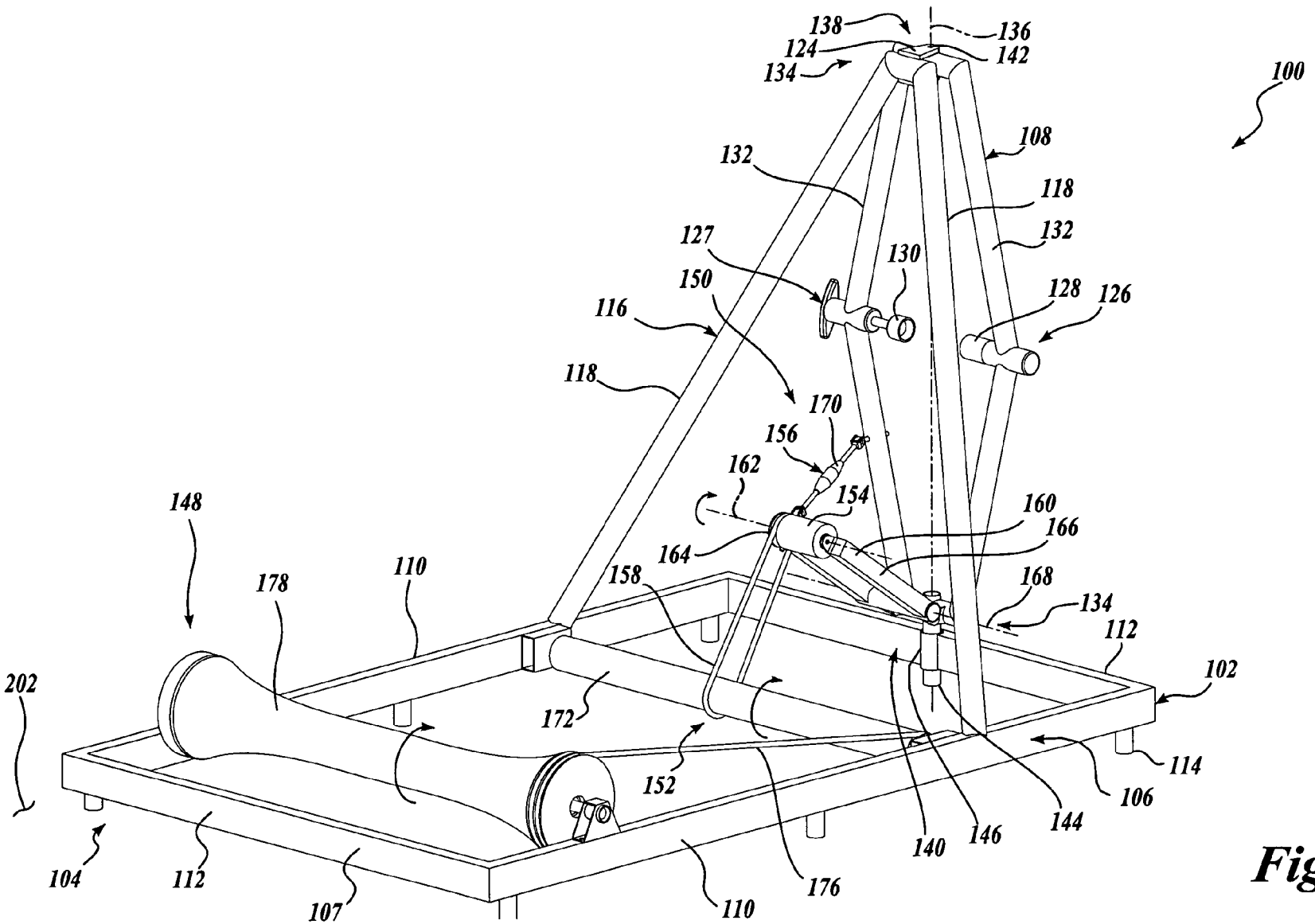
FIG. 2 is an isometric view of the bicycle trainer of FIG. 1.
Figure 3:
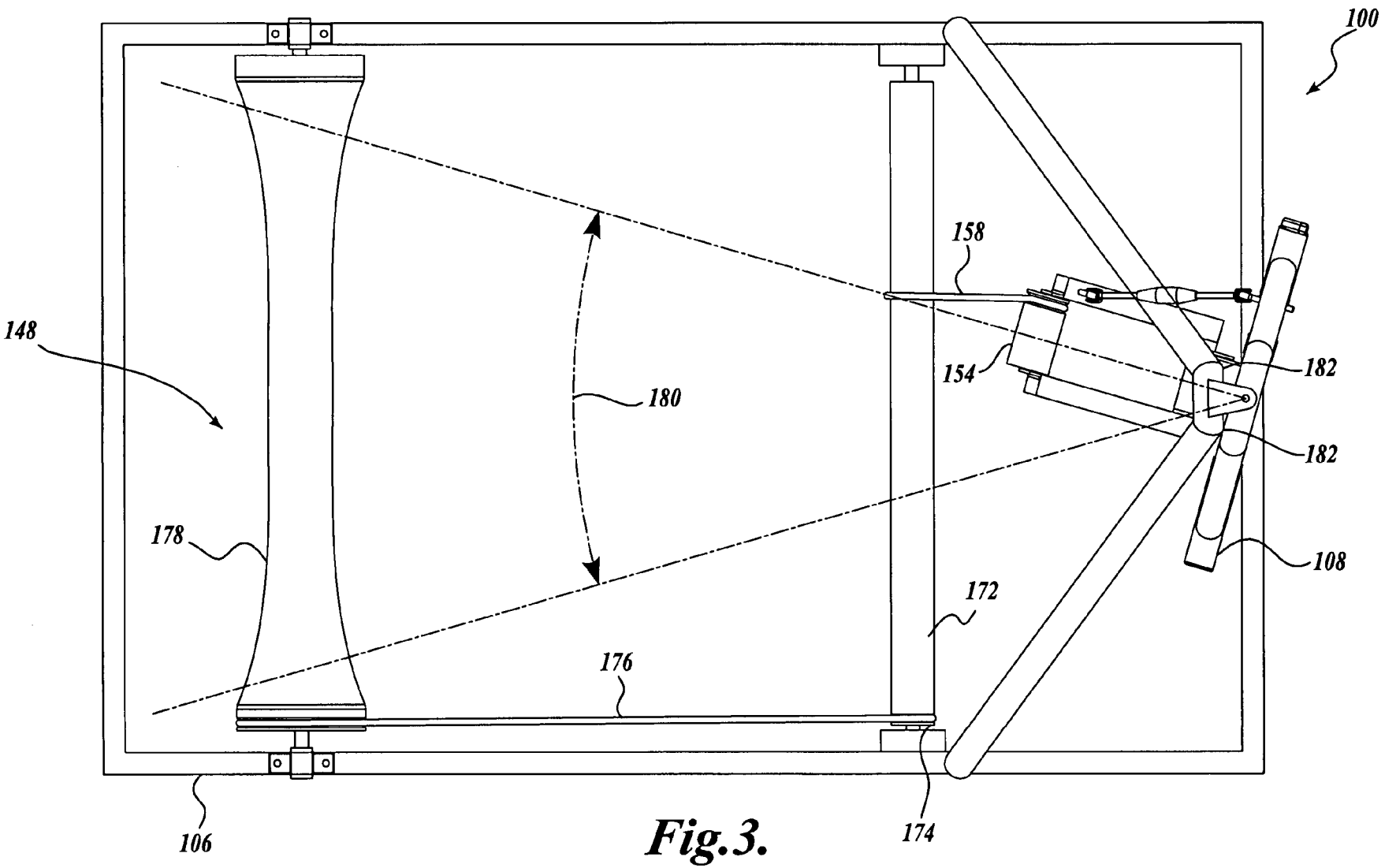
FIG. 3 is a top planar view of the bicycle trainer of FIG. 2.

A bicycle trainer 100 constructed in accordance with one embodiment of the present invention may be best understood by referring to FIGS. 1-3. The bicycle trainer 100 is adapted to permit a bicycle 200 and a rider (not shown) to be supported in an upright, stationary position while the rider pedals. Although the bicycle trainer 100 is illustrated as being used with a recumbent bicycle, it should be apparent that the bicycle trainer is not limited to such a bicycle and that other bicycle types are also within the scope of the present invention.

As may be best seen by referring to FIG. 2, the bicycle trainer 100 includes a frame assembly 102 and a roller assembly 104. The frame assembly 102 includes a stationary frame 106 portion and a rotating frame (or attachment assembly) 108 portion. The stationary frame 106 is adapted to rest upon a support surface 202, such as a floor or a ground surface, on a plurality of optional legs 114. The stationary frame 106 includes a base portion 107 having a pair of side frame rails 110 spaced by a pair of end frame rails 112.

The rotating frame 108 includes a pair of upright stanchions 132. The stanchions 132 are coupled to one another at their ends and are selectively spaced to receive the rear wheel of a bicycle therebetween. The upper ends of the stanchions 132 are supported by a support frame 116. The support frame 116 includes a pair of legs 118 extending downwardly and are attached to the stationary frame 106.

The rotating frame 108 also includes a bicycle coupling assembly 126. The bicycle coupling assembly 126 is suitably formed with the stanchions 132 and is positioned on each stanchion 132 in an opposed manner to receive a rear hub (FIG. 1) of the bicycle. The bicycle coupling assembly 126 is adapted to couple the bicycle to the rotating frame 108. The bicycle coupling assembly 126 includes a clamp assembly 127 for clamping upon the ends of a rear axle 206 of the bicycle 200. The clamp assembly 127 includes a first receiving member 128, such a cup shaped member, for receiving one end of the rear axle 206.

The clamp assembly 127 also includes a second receiving member 130 disposed opposite the first receiving member 128, which may also be a cup shaped member, for receiving the other end of the rear axle 206. Preferably, at least the second receiving member 130 is adjustable in position relative to the first receiving member 128 to accommodate bicycles of differing sizes. The adjustable aspect of the second receiving member 130 also permits the application of a clamping force to the rear axle 206 to securely couple the bicycle 200 to the rotating frame 108. In certain embodiments, both the first and second receiving members 128 and 130 are adjustable relative to each other. In still yet other embodiments, only the first receiving member 128 is adjustable relative to the second receiving member 130.

The lower ends of the stanchions 132 are attached to a pivot assembly 134. The pivot assembly 134 couples the rotating frame 108 to the stationary frame 106. The pivot assembly 134 allows the rotating frame 108, and any bicycle attached thereto, to angularly move relative to the stationary frame 106 on bearings (not shown). For instance, the pivot assembly 134 allows the rotating frame 108 to pivot about a rotation axis 136 (FIG. 2). The rotation axis 136 is suitably located substantially perpendicular to the support surface 202, although those skilled in the art will appreciate that the rotation axis 136 may be inclined relative to the support surface 202 at other angles. As the rotating frame 108 pivots about the rotation axis 136, the bicycle 200, also pivots about the rotation axis 136, thereby simulating the turning of the bicycle.

The pivot assembly 134 includes an upper pivot assembly 138 and a lower pivot assembly 140. The upper pivot assembly 138 includes a bracket 124 mounted to the top of the support frame 116. The bracket 124 is a clevis style pivot bracket; however it should be apparent to those skilled in the art that other pivot assemblies are suitable for use with and are within the scope of the present invention. A rotation pin 142, suitably mounted on bearings (not shown), passes through the bracket 124 and the rotating frame 108. The rotation pin 142 permits the upper portion of the rotating frame 108 to selectively rotate about the rotation axis 136.

The lower pivot assembly 140 includes a pivot pin 144 passing through a bushing 146 in the stationary frame 106. The pivot pin 144 is concentrically aligned with the rotation axis 136 and permits the lower portion of the rotating frame 108 to rotate about the rotation axis 136.

Still referring to FIG. 2, the roller assembly 104 will now be described in greater detail. The roller assembly 104 includes a front roller assembly 148, a rear roller assembly 150, and a power transfer assembly 152. The rear roller assembly 150 includes a drive roller 154, an adjustment assembly 156, a drive belt 158, and a frame 160. The drive roller 154 is configured to rotatingly engage the rear wheel of a bicycle and rotate about a substantially horizontal rotation axis 162 oriented substantially parallel to the support surface 202 and substantially perpendicular to the rotation axis 136 of the rotating frame 108. One end of the drive roller 154 also includes a pulley 164 for receiving the drive belt 158 and transferring rotation, as described in greater detail below.

The frame 160 includes a pair of spaced arms 166, with the distal ends of the arms 166 coupled to the drive roller 154. The other ends of the arms 166 are rotatingly coupled to the rotating frame 108, such that the rear wheel frame 160 is able to rotate about a rotation axis 168.

The adjustment assembly 156 permits the spacing of the drive roller 154 to be selectively adjusted relative to a tire of the bicycle. More specifically, the adjustment assembly 156 permits the position of the drive roller 154 to be adjusted closer or farther from the wheel of the bicycle to accommodate different rim and tire sizes and, if desirable, to vary the contact pressure between the tire and the drive roller 154.

The adjustment assembly 156 includes a turnbuckle 170 that is adjustable in length. A first end of the turnbuckle 170 is coupled to the rotation frame 108 and the other end is coupled to the frame 160. Shortening the length of the turnbuckle 170 draws the drive roller 154 closer to the tire of the bicycle and/or increases the contact pressure between the drive roller 154 and the tire of the bicycle. Extending the length of the turnbuckle 170 moves the drive roller 154 farther from the tire of the bicycle and/or decreases the contact pressure between the drive roller 154 and the tire of the bicycle.

Although a specific adjustment assembly is illustrated and described, those skilled in the art will appreciate that the adjustment assembly may take many other forms. As an example, biasing devices, such as springs and elastic materials, can be used to bias the drive roller 154 toward the rear wheel. As a result, such devices are also within the scope of the present disclosure.

The power transfer assembly 152 includes a power transfer roller 172 rotatingly coupled to the stationary frame 106. As configured, the power transfer roller 172 is able to rotate about a rotation axis that is oriented substantially parallel to the support surface 202 and parallel to the rotation axis 162 of the drive roller 154 when the frame 160 is longitudinally aligned. The power transfer roller 172 is sized and configured to be engaged and rotated by the drive belt 158 such that power transferred from the bicycle to the rear wheel drive roller 154 is subsequently transferred to the power transfer roller 172. In the illustrated embodiment, the drive belt 158 is permitted to move transversely along the length of the power transfer roller 172, such that when the rotating frame 108 is rotated, the position of engagement of the drive belt 158 to the power transfer roller 172 moves accordingly.

As may be best seen by referring to FIG. 3, the power transfer roller 172 includes a pulley 174 for receiving a drive belt 176. As configured, one end of the drive belt 176 transfers torque from to the power transfer roller 172 to the front roller assembly 148.

Returning to FIG. 2, the front roller assembly 148 includes a front wheel roller 178 rotatingly coupled to the stationary frame 106. The front wheel roller 178 is able to rotate about a rotation axis oriented substantially parallel to the support surface 202 and substantially normal to the longitudinal direction of the stationary frame 106. The front roller 178 is configured to engage and rotate a front wheel 208 (see FIG. 1) of the bicycle utilizing the power generated by the rear wheel of the bicycle and transferred to the front wheel roller 178 by the drive belts 158 and 176.

The front wheel roller 178 is contoured to have a non-linear outer surface. Preferably, the front wheel roller 178 is contoured such that the front wheel roller 178 is hourglass in shape, wherein it has a greater diameter at the outer ends of the front wheel roller 178 than at its center. The contoured shape of the front wheel roller 178 aids in keeping the front wheel on the front wheel roller 178 during use. Specifically, the sloped end portions tend to direct the front wheel of the bicycle back toward the center of the front wheel roller 178. Although the front wheel roller 178 is illustrated and described as being contoured, those skilled in the art will appreciate that the front wheel roller 178 may be alternately shaped, such as to have a linear outer surface.

Operation of the bicycle trainer 100 may be best understood by referring to FIGS. 1-3. The bicycle 200 is coupled to the bicycle trainer 100 by the bicycle clamping assembly 127. More specifically, the bicycle clamping assembly 127 is clamped to the rear axle 206 of the rear wheel 210 of the bicycle. This locks the frame 204 of the bicycle 200 to the rotating frame 108 such that the any rotation of the frame 204 results in rotation of the rotating frame 108. The position of the rear wheel drive roller 154 relative to the rear wheel 210 is adjusted by the adjustment assembly 156. The front wheel 208 of the bicycle 200 rests on the front roller 178.

During use, the bicycle 200 is supported in the upright position by the coupling of the bicycle 200 to the rotating frame 108. The user then pedals the bicycle 200, which causes the rear wheel 210 to spin. The spinning of the rear wheel 210 in turn causes the wheel roller 154 to rotate. Rotation of the wheel roller 154 causes rotation of the power transfer roller 172, as the two are connected by the drive belt 158. Because of the drive belt 176, rotation of the power transfer roller 172 causes rotation of the front roller 178 and also causes rotation of the front wheel 208 of the bicycle 200 supported thereon.

The user may turn the bicycle 200 by rotating a handle bar 212 of the bicycle 200. This causes the rotating frame 108 to rotate and the front wheel 208 of the bicycle 200 to travel along at least a portion of the front wheel roller 178, thereby simulating turning of the bicycle 200. Thus, the illustrated embodiment of the bicycle trainer 100 permits a user to simulate turns of the bicycle 200 on a bicycle trainer while still providing some upright support to the bicycle 200.

As may be best seen by referring to FIG. 3, when the user turns the bicycle, the front wheel travels transversely outward from the center of the front roller 178 toward one of the ends of the front roller 178. As the bicycle turns, the rotating frame 108, rotates to accommodate turning of the bicycle. The drive belt 158 travels transversely along the length of the power transfer roller 172, stretching as it moves to accommodate the increased distance between the power transfer roller 172 and the rear wheel drive roller 154. In the illustrated embodiment, the rotating frame 108 is able to rotate through an angular displacement 180. Preferably, a limit stop 182 is used to contact and impede the rotating frame 108 from over-rotating to prevent the front wheel of the bicycle from moving transversely off of the front wheel roller 178.

Although the illustrated and described bicycle trainer is illustrated and described as utilizing a power transfer roller assembly, those skilled in the art will appreciate that the power transfer roller assembly is an optional component, and in alternate embodiments, the front wheel roller is driven by other means, such as directly from the rear wheel drive roller.

Although not illustrated, those skilled in the art will appreciate that the bicycle trainer may include well known resistance devices for providing variable resistance to pedal movement, a few suitable examples being fluid, magnetic, and/or fan resistance devices.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A bicycle trainer, comprising:

(a) a stationary frame configured to rest on a support surface;

(b) a support frame extending upwardly from the stationary frame;

(c) a rotating frame pivotally coupled to the stationary frame at a lower end of the rotating frame and pivotally coupled to the support frame at an upper end of the rotating frame such that the rotating frame is pivotal around a rotation axis that is substantially perpendicular to the support surface when the stationary frame is resting on the support surface; and (d) an attachment assembly coupled to the rotating frame and configured to couple a bicycle to the rotating frame such that the bicycle is pivotal with the rotating frame about the rotation axis in response to user input.

2. The bicycle trainer of claim 1, wherein the attachment assembly includes a first roller assembly adapted to engage a wheel of the bicycle.

3. The bicycle trainer of claim 2, wherein the first roller is adjustably coupled to the attachment assembly to permit selective positioning of the first roller assembly relative to the attachment assembly.

4. The bicycle trainer of claim 2, further comprising a second roller assembly coupled to the stationary frame and positioned to engage a front wheel of the bicycle during use.

5. The bicycle trainer of claim 4, further comprising a power transfer assembly attached to the stationary frame.

6. The bicycle trainer of claim 5, wherein the power transfer assembly is in communication with the first and second roller assemblies for synchronizing rotational motion between the first and second roller assemblies.

7. The bicycle trainer of claim 5, wherein the second roller assembly includes a roller having a contour adapted to permit a front wheel of the bicycle to freely traverse between ends of the roller.

8. The bicycle trainer of claim 7, wherein the ends of the roller are contoured to assist in maintaining alignment of the front wheel between the ends of the roller.

9. A bicycle trainer, comprising:

(a) a stationary frame adapted to rest upon a support surface;

(b) a first roller assembly coupled to the stationary frame, the first roller assembly having a first roller rotatingly engageable with a first wheel of a bicycle; and (c) a second roller assembly having a second roller rotatingly engageable with a second wheel of the bicycle, the second roller assembly pivotally coupled to the stationary frame such that the second roller assembly is pivotal about a rotation axis that is substantially perpendicular to the support surface when the stationary frame is resting on the support surface to permit pivoting of the bicycle about the rotation axis while rotatingly engaging the second wheel of the bicycle.

10. The bicycle trainer of claim 9, wherein rotation of the first and second rollers is synchronized by a power transfer assembly.

11. The bicycle trainer of claim 10, wherein the power transfer assembly is coupled to the first roller assembly by a first belt and the power transfer assembly is coupled to the second roller assembly by a second belt.

12. The bicycle trainer of claim 10, wherein the first roller is contoured to permit a front wheel of the bicycle to freely traverse between ends of the first roller during use.

13. The bicycle trainer of claim 9, further comprising an adjustment assembly extending between the second roller assembly and a portion of the bicycle trainer to permit selective adjustment of the second roller assembly relative to the second wheel of the bicycle when the bicycle is coupled to the bike trainer.

14. A bicycle trainer, comprising:

(a) a stationary frame adapted to rest upon a support surface; and (b) a rotating frame pivotally coupled to the stationary frame such that the rotating frame is pivotal about a rotation axis that is substantially perpendicular to the support surface when the stationary frame is resting on the support surface, the rotating frame including a bicycle coupling assembly adapted to restrain a bicycle to the bicycle trainer during use and a roller assembly coupled to the rotating frame such that the entire roller assembly is pivotal about the rotation axis, wherein the rotating frame permits the bicycle to pivot about the rotation axis.

15. The bicycle trainer of claim 14, wherein the roller assembly having a first roller sized and configured to engage a wheel of the bicycle when the bicycle is attached to the bicycle trainer.

16. The bicycle trainer of claim 15, wherein the first roller is adjustably coupled to the bicycle coupling frame by an adjustment assembly to permit selective adjustment of the first roller relative to a rear wheel of the bicycle when the bicycle is attached to the bicycle trainer.

17. The bicycle trainer of claim 16, further comprising a second roller coupled to the stationary frame and configured to rotatably engage a front wheel of the bicycle when the bicycle is attached to the bicycle trainer.

18. The bicycle trainer of claim 17, wherein rotation of the first and second rollers is synchronized by a power transfer assembly.

* * * * *